United States Patent [19]

Gaiffi et al.

[11] 4,144,105

[45] Mar. 13, 1979

[54] METHOD OF MAKING CERIUM MISCH-METAL/COBALT MAGNETS

[75] Inventors: Sevi Gaiffi; Anton Menth, both of Nussbaumen; Harmut Nagel, Wettingen, all of Switzerland

[73] Assignee: BBC Brown, Boveri & Company, Limited, Baden, Switzerland

[21] Appl. No.: 721,769

[22] Filed: Sep. 9, 1976

Related U.S. Application Data

[63] Continuation-in-part of Ser. No. 603,726, Aug. 11, 1975, abandoned.

[30] Foreign Application Priority Data

Aug. 13, 1974 [CH] Switzerland ..... 11025/74

[51] Int. Cl.[2] ..... H01F 1/08

[52] U.S. Cl. ..... 148/103; 148/31.57; 148/108; 148/122; 75/152

[58] Field of Search ..... 148/103, 102, 105, 108, 148/31.57, 122; 75/152, 84

[56] References Cited

U.S. PATENT DOCUMENTS

| | | | |
|---|---|---|---|
| 3,682,716 | 8/1972 | Martin et al. | 148/31.57 |
| 3,873,379 | 3/1975 | Yamakawa et al. | 148/103 |
| 3,919,001 | 11/1975 | Ratnam | 148/31.57 |
| 3,947,295 | 3/1976 | Tawara et al. | 148/31.57 |
| 4,003,767 | 1/1977 | Bachmann et al. | 148/103 |

OTHER PUBLICATIONS

Strnat, K.; *Co-Re Alloys As . . . Perm. Mag. Materials,* in Cobalt, 36, Sep. 1967, pp. 133-143.

*Primary Examiner*—R. Dean

*Assistant Examiner*—Michael J. Lewis

*Attorney, Agent, or Firm*—Oblon, Fisher, Spivak, McClelland & Maier

[57] ABSTRACT

A permanent magnetic material, predominantly containing cerium misch-metal (CeMM) and cobalt, characterized by the composition:

$$(CeMM_{1-x}RE_x)_{1-y}Sm_yCo_{5\pm0.2}$$

wherein $$0<x<0.5;\ 0\leqq y\leqq 0.25,$$

wherein cerium misch-metal approximately possesses the composition $$Ce_\alpha\ La_\beta\ Nd_\gamma Pr_\delta,\ \text{where}$$

$0.45<\alpha<0.55$ $0.20<\beta<0.40$ $0.05<\gamma<0.15$ $0.00<\delta<0.05$ and $\alpha+\beta+\gamma+\delta\simeq1$.

and wherein RE consists of the alloy $$Nd_A Pr_B\,(Ce, La, Sm)_C$$

wherein A is 0.75, B is 0.22, C is less than 0.03 and $A+B+C=1$.

2 Claims, 1 Drawing Figure

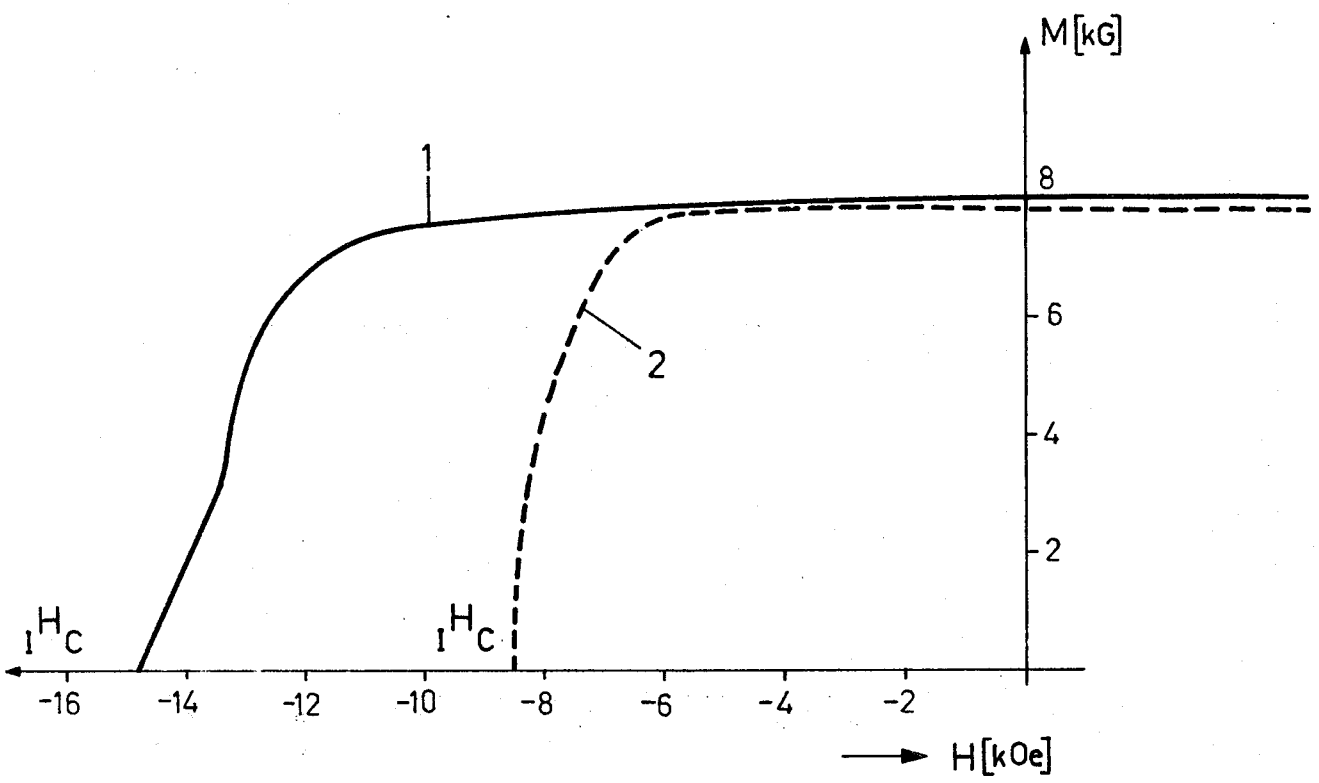
M[kG]
8
6
4
2
H[kOe]
-2
-4
-6
-8
-10
-12
-14
-16
$_IH_c$
$_IH_c$
1
2

METHOD OF MAKING CERIUM MISCH-METAL/COBALT MAGNETS

CROSS REFERENCE TO RELATED APPLICATIONS

This application is a continuation-in-part of application Ser. No. 603,726 filed Aug. 11, 1975, now abandoned, refiled on June 17, 1977, as Ser. No. 808,135, now U.S. Pat. No. 4,087,291.

BACKGROUND OF THE INVENTION

1. Field of the Invention

The present invention relates to permanent magnetic material, predominantly containing cerium misch-metal (CeMM) and cobalt and to a process for the production of the same.

2. Description of the Prior Art

This type of material has already been variously described in the literature. For example, D. V. Ratnam and M. G. H. Wells, (AIP Conf. Proc. 18, American Institute of Physics, New York) have reported the properties of certain misch-metal/cobalt magnets. They disclosed individual magnets with energy products of up to 15 MGOe and coercive fields of up to 14 kOe. However, these magnets show demagnetizing curves of only moderately pronounced rectangular shape.

Cerium misch-metal is the term used for the light rare earths, separated from ores. For example, B. V. Kleber and B. Love (Technology of Scandium, Yttrium and the Rare Earth Metals, Pergamon Press, New York 1963, p. 10), report that Bastnaesite and Monazite, respectively, show the following percentage contents of rare earths:

| | Bastnaesite | Monazite |
|---|---|---|
| La | 30 | 38 |
| Ce | 50 | 48.5 |
| Pr | 4 | 3.6 |
| Nd | 14 | 8.8 |
| Sm | 1 | 0.5 |

As can be seen, the composition of cerium misch-metal is not constant but fluctuates according to the starting ore. For the most important constituents, cerium, lanthanum, neodymium and praseodymium, the contents generally fluctuate at least between 45 and 55, 20 and 40, 5 and 14, and 0 and 5 atom-percent, respectively. Thus, it is certainly not surprising that it is difficult to produce magnets containing cerium misch-metal such as samarium magnets with a cerium misch-metal additive, which have satisfactory properties with reproducible values from magnet to magnet.

SUMMARY OF THE INVENTION

It is the object of the present invention to reduce the cost of the material described in the said parent application by the use of particular mixtures of rare-earth metals, so that not only magnetic characteristics as good as those of the material of the parent application are provided, but the material may also be more economically provided.

Briefly, these and other objects of this invention, as will hereinafter become clear by the ensuing discussion, have been attained by providing a material which is characterized by the composition $$(CeMM_{1-x}RE_x)_{1-y}Sm_yCo_{5\pm 0.2},$$

where $0<x<0.5$; $0\leqq y\leqq 0.25$ and preferably x is 0.05 to 0.50 and y is 0 to 0.25. The cerium misch-metal indicated as CeMM, approximately possesses the composition $Ce_\alpha La_\beta Nd_\gamma Pr_\delta$, where $0.45<\alpha<0.55$, prefereably 0.50 to 0.55 and most preferably 0.54; $0.20<\beta<0.40$, preferably 0.30 to 0.35 and most preferably 0.32; $0.05<\gamma<0.15$, preferably 0.10 to 0.15 and most preferably 0.12; $0.00<\delta<0.05$. preferably 0.03 to 0.05 and most preferably 0.04; and $\alpha+\beta+\gamma+\delta\simeq 1$, and RE has the atomic composition $$Nd_A\,Pr_B\,(Ce, La, Sm)_C$$

where A is 0.75, B is 0.22, C is less than 0.03 and $A+B+C=1$.

The RE alloy will be hereafter referred to by its trade name "didymium".

BRIEF DESCRIPTION OF THE DRAWINGS

A more complete appreciation of the invention and many of the attendant advantages thereof will be readily attained as the same becomes better understood by reference to the following detailed description when considered in connection with the accompanying Drawings, wherein:

The FIGURE shows the magnetization curves for two permanent magnetic materials. Material 1 is an alloy of the invention and Material 2 is provided for reference.

DESCRIPTION OF THE PREFERRED EMBODIMENTS

According to the method of this invention, a permanent magnet material as described above is prepared from a starting alloy comprising mixing a comminuted alloy of 5 parts of cobalt with one part of said cerium misch-metal and a comminuted alloy of five parts of cobalt with one part of said further alloy, grinding said mixture under a protective gas such as helium, argon or nitrogen to a particle size in the range 2–10 microns, aligning the powder particles in a magnetic field at approximately 50 KOe, isostatically compressing the powder to a pressed body, sintering the body at a temperature in the range 1035°–1045° C. and heat-treated at a temperature above 300° C. It is advisable to use a sintering additive, which is mixed with the starting alloy. A suitable sintering additive is an alloy containing 50 to 70 percent by weight, preferably about 60%, of rare earth metal, particularly Ce, La, Nd, Pr or Sm, and 30 to 50 percent by weight, preferably about 40% of cobalt, which can represent about 10–14 percent by weight of the total weight of the mixture. It is of particular advantage, in this case, to grind the mixture consisting of sintering additive and starting alloy in coarsely disintegrated form, in a reverse jet mill.

The addition of didymium to cerium misch-metal to form the initial alloy very considerably reduces the costs of the resulting permanent magnet material of the parent application, since the didymium is substantially less expensive than the pure rare-earth metals, such as neodymium, praesodymium, lanthanum and cerium. In addition the high neodymium content of the didymium has the effect that advantageous magnetic characteristics, especially high coercive force, of the permanent magnet material of the parent application are attained. It is particularly advantageous in carrying out the method of manufacture of the material in accordance with the invention, that didymium (Di) can be alloyed without difficulty with cobalt to form $DiCo_5$, and this alloy can be processed with the other $RECo_5$alloys.

A further improvement of the material according to the invention may be obtained by the use of additional heat treatment as will now be described.

The magnetic materials are first annealed at a temperature in the range of 950°–1020° C. for a time between 20 minutes and 50 hours. After the annealing operation the material was rapidly cooled, e.g. by quenching in a liquid such as liquid nitrogen, glycerin or some other oily organic liquid, such as silicone oil. Cooling in a cold protective gas atmosphere, such as argon or nitrogen, has also proved to be very suitable. A further improvement of the magnetic properties was produced by a subsequent tempering treatment at a temperature in the range 300°–600° C. for 10 to 60 minutes.

It is found that a temperature of 980 ± 10° C. is optimum for annealing, and that the preferred tempering temperature and time are 350° C. and 30–40 minutes.

EXAMPLES

The following description of tests, experiments, and sample compositions are provided for purposes of illustration only and are not intended to be limiting unless otherwise specified.

The single FIGURE shows magnetization curves for two permanent magnet materials 1 and 2, material 2 (given for reference) having the composition $(CEMM_{0.85}Sm_{0.15})Co_5$ and material 1 having the composition $CEMM_{0.75}Di_{0.25})_{0.85}Sm_{0.15}Co_5$. The magnetizing field strength H in kilooersteds is plotted on the abscissae and the induction M in kilogauss on the ordinates.

Material 2 is manufactured from a $CEMMCo_5$ starting alloy with the addition of a samarium/cobalt alloy consisting of 60 weight percent samarium and 40 weight percent cobalt.

The starting alloy for material 1 was coarsely comminuted $CEMMCo_5$ and $DiCo_5$ alloys that were mixed in the weight ratio of 3:1. This starting alloy was mixed with a sintering additive consisting of 60 weight percent samarium and 40 weight percent cobalt.

For both materials the sintering additive made up some 14 percent of the total weight. After manufacture of the mixture of starting alloy and sintering additive the respective mixtures for materials 1 and 2 were each reduced in a mill in a protective atmosphere to a powder of a particle size of 2–10 microns. The powder formed was aligned in a magnetic field of some thousands of Oersteds, isostatically compressed to form a moulded body, sintered at a temperature in the range 1035°–1045° C. and heat-treated at a temperature above 300° C. The magnetization curves of the materials were measured at field strengths up to a maximum of 50 kOe, using a (fluxmetric method).

From the magnetization curves in the drawing it may be discerned that the material 1 in accordance with the present invention has a coercive force of about 15 kOe, which is substantially higher than that of the material 2 without didymium (given for comparison) for which the coercive force is approximately 8.5 kOe, and almost exactly as high as the value for the material in accordance with the parent application.

Having now fully described the invention, it will be apparent to one of ordinary skill in the art that many changes and modifications can be made thereto without departing from the spirit or scope of the invention as set forth herein.

What is claimed as new and intended to be secured by Letters Patent is:

1. A method of preparing a permanent magnet having improved coercive field strength and having the composition:

$$((CeMM)_{1-x}RE_x)_{1-y}Sm_yCo_{5\pm0.2}$$

wherein $0.05 < x < 0.5$, $0 \leqq y \leqq 0.25$, the CEMM has the atomic composition:

$$Ce_\alpha\ La_\beta\ Nd_\gamma\ Pr_\delta,$$

wherein $0.45 < \alpha < 0.55$
$0.20 < \beta < 0.40$
$0.05 < \gamma < 0.15$
$0.00 < \delta < 0.05$ and $\alpha + \beta + \gamma + \delta = 1$, wherein RE consists of the alloy having the atomic composition:

$$Nd_A Pr_B\ (Ce, La, Sm)_C$$

wherein A is 0.75, B is 0.22, C is less than 0.03 and A + B + C = 1; which consists essentially of mixing 1-x parts of comminuted $CeMMCo_5$, x parts of comminuted $RECo_5$, wherein Re and CeMM are as defined previously and 10 to 14 wt.% based on the total mixture of a sintering additive consisting of 50 to 70 wt.% Sm and 50 to 30 wt.% Co;

grinding said mixture under a protective gas to a particle size in the range of 2 to 10 microns;

aligning the powder particles in a magnetic field at approximately 50 kOe;

isostatically compressing the powder to a pressed body;

sintering the body at a temperature in the range of 1035° to 1045° C.; and heat-treating said body at a temperature above 300° C.

2. The method of claim 1, wherein the permanent magnet has the composition:

$$(CeMM_{0.75}RE_{0.25})_{0.85}Sm_{0.15}Co_5.$$

* * * * *